US008609596B2

(12) United States Patent
Okada et al.

(10) Patent No.: US 8,609,596 B2
(45) Date of Patent: Dec. 17, 2013

(54) GEAR OIL COMPOSITION

(75) Inventors: Tahei Okada, Chiba (JP); Shigeo Hara, Chiba (JP)

(73) Assignee: Idemitsu Kosan Co., Ltd., Tokyo (JP)

( * ) Notice: Subject to any disclaimer, the term of this patent is extended or adjusted under 35 U.S.C. 154(b) by 365 days.

(21) Appl. No.: 12/528,815

(22) PCT Filed: Mar. 19, 2008

(86) PCT No.: PCT/JP2008/055063

§ 371 (c)(1),
(2), (4) Date: Aug. 27, 2009

(87) PCT Pub. No.: WO2008/120581

PCT Pub. Date: Oct. 9, 2008

(65) Prior Publication Data

US 2010/0113314 A1 May 6, 2010

(30) Foreign Application Priority Data

Mar. 29, 2007 (JP) ..... 2007-086939

(51) Int. Cl.

| | |
|---|---|
| ***C10M 101/00*** | (2006.01) |
| ***C10M 135/18*** | (2006.01) |
| ***C10M 129/70*** | (2006.01) |
| ***C10M 129/74*** | (2006.01) |
| ***C10M 129/76*** | (2006.01) |

(52) U.S. Cl.
USPC ..... 508/463; 508/110; 508/459; 508/485

(58) Field of Classification Search
USPC ..... 508/433, 485, 363, 443, 575, 577, 110, 508/335, 459, 463
See application file for complete search history.

(56) References Cited

U.S. PATENT DOCUMENTS

| | | | | |
|---|---|---|---|---|
| 3,876,550 | A | 4/1975 | Holubec | |
| 5,698,502 | A * | 12/1997 | Pafford et al. | 508/485 |
| 5,726,135 | A | 3/1998 | Khorramian | |
| 6,402,983 | B1 | 6/2002 | Abe et al. | |
| 6,436,881 | B1 | 8/2002 | McHenry et al. | |
| 6,649,574 | B2 * | 11/2003 | Cardis et al. | 508/280 |
| 6,656,888 | B1 * | 12/2003 | Zehler | 508/485 |
| 2003/0125218 | A1 * | 7/2003 | Cardis et al. | 508/208 |
| 2005/0082139 | A1 * | 4/2005 | Ishikawa et al. | 192/107 M |
| 2007/0265175 | A1 * | 11/2007 | Kurosawa et al. | 508/162 |

FOREIGN PATENT DOCUMENTS

| | | |
|---|---|---|
| JP | 57 164191 | 10/1982 |
| JP | 6 228579 | 8/1994 |
| JP | 2004 528477 | 9/2004 |
| JP | 2005 520038 | 7/2005 |
| JP | 2005 290181 | 10/2005 |
| JP | 2005 290182 | 10/2005 |
| JP | 2005 290183 | 10/2005 |
| WO | 2005 073353 | 8/2005 |
| WO | WO 2005118758 A1 * | 12/2005 |

OTHER PUBLICATIONS

Extended European Search Report issued Aug. 24, 2011, in Patent Application No. 08722450.7.

* cited by examiner

*Primary Examiner* — Pamela H Weiss
(74) *Attorney, Agent, or Firm* — Oblon, Spivak, McClelland, Maier & Neustadt, L.L.P.

(57) ABSTRACT

To provide a gear oil composition containing a base oil, and compounded therein, (A) an ashless dithiocarbamate compound and (B) an ester of pentaerythritol and a $C_{12}$ to $C_{20}$ branched fatty acid, the ester having a hydroxyl value of 20 to 100 mg KOH/g. The gear oil composition has a high transmission efficiency and shows both of resistance to sludge formation and extreme pressure property.

16 Claims, No Drawings

GEAR OIL COMPOSITION

CROSS REFERENCE TO RELATED APPLICATION

This application is a 371 of PCT/JP08/055063, filed on Mar. 19, 2008, and claims priority to Japanese Patent Application No. 2007-086939, filed on Mar. 29, 2007.

TECHNICAL FIELD

The present invention relates to a gear oil composition and, more specifically, to a gear oil composition having a high transmission efficiency and an energy saving effect and showing excellent resistance to sludge formation and extreme pressure property.

BACKGROUND ART

In recent years, to improve the working efficiency of various industrial machines has been one of the important challenges. Thus, gears used in the industrial machines are required to be able to operate in a stable manner even in harsh conditions such as high speed and high load conditions. With an increase of required performance of gears, demands for high performance gear oils are also increasing. Thus, various additives for the oils have thus far been developed. For example, addition of an extreme pressure additive such as MoDTC is known to be effective for use in high load conditions and to be able to obtain an improvement of the transmission efficiency and an excellent resistance to abrasion.

However, MoDTC has a problem because of its poor heat resistance and its tendency to form a sludge and, therefore, is used only for a limited scope of application as an additive for gear oils. On the other hand, a gear oil composition which does not contain MoDTC and which has less tendency to form a sludge does not have fully satisfactory performance with respect to the transmission efficiency and wear resistance. Therefore, there still exists a demand for a further improved gear oil composition.

In this circumstance, there have been disclosed, in recent years, additives that aim at an improvement of various performances and gear oils containing such additives. For example, Patent Document 1 discloses a gear oil composition which is aimed at improving resistance to sludge formation and extreme pressure property and which contains a phosphorus-containing carboxylic acid compound and a phosphorothionate. Patent Document 2 discloses a gear oil composition which is aimed at improving resistance to sludge formation and water separating performance and which contains a dispersion-type viscosity index improver. Further, Patent Document 3 discloses a gear oil composition which is aimed at improving energy saving property and which contains a specific carboxylic acid or carboxylic acid derivative.

While Patent Documents 1 to 3 disclose gear oils which are to cope with energy saving of industrial machines, there is still a room for improving performances such as energy saving effect, resistance to sludge formation and extreme pressure property. Namely, there is a demand for a further improvement of performances.

[Patent Document 1] Japanese Unexamined Patent Application Publication No. 2005-290181

[Patent Document 2] Japanese Unexamined Patent Application Publication No. 2005-290182

[Patent Document 3] Japanese Unexamined Patent Application Publication No. 2005-290183

DISCLOSURE OF THE INVENTION

Problem to be Solved by the Invention

The present invention has been made under the above-described circumstances and it is, therefore, an object of the present invention to provide a gear oil composition having a high transmission efficiency and showing both of resistance to sludge formation and extreme pressure property.

Means for Solving the Problem

The present inventors have made an earnest study with a view toward accomplishing the above object and, as a result, found that a gear oil composition containing an ashless dithiocarbamate compound and a specific ester can solve the above problem. The present invention has been completed based on the above finding. That is, the present invention provides a gear oil composition comprising a base oil, and incorporated therein, (A) an ashless dithiocarbamate compound and (B) an ester of pentaerythritol and a $C_{12}$ to $C_{20}$ branched fatty acid, the ester having a hydroxyl value of 20 to 100 mg KOH/g.

Effect of the Invention

According to the present invention, a gear oil composition having a high transmission efficiency and shows both of resistance to sludge formation and extreme pressure property is provided.

BEST MODE FOR CARRYING OUT THE INVENTION

A gear oil composition according to the present invention is characterized by comprising a base oil, and incorporated therein, (A) an ashless dithiocarbamate compound and (B) an ester of pentaerythritol and a $C_{12}$ to $C_{20}$ branched fatty acid, the ester having a hydroxyl value of 20 to 100 mg KOH/g.

As the base oil, one or a plurality of base oils selected from mineral oils and synthetic oils may be used. The base oil preferably has a kinematic viscosity at 40° C. of 10 to 4,600 $mm^2/s$, more preferably 20 to 1,000 $mm^2/s$, and particularly preferably 32 to 500 $mm^2/s$. A kinematic viscosity at 40° C. of less than 10 $mm^2/s$ will cause a disadvantage that the mass reduction by evaporation becomes significant. Too high a kinematic viscosity in excess of 4,600 $mm^2/s$ may cause a significant power loss due to viscosity resistance. It is also preferred that the base oil have a pour point of −5° C. or lower, more preferably −15° C. or lower, still more preferably −25° C. or lower, from the standpoint of properties at low temperatures. The viscosity index of the base oil is preferably 80 or more, particularly preferably 95 or more. A temperature dependency of the viscosity of a base oil having a viscosity index of less than 80 becomes so significant that it is difficult to obtain a gear oil composition having excellent temperature characteristics.

As specific examples of the mineral oil, there may be mentioned refined oils obtained by refining, in a conventional manner, a distilled oil produced by subjecting a paraffin base crude oil or an intermediate base crude oil to atmospheric distillation or subjecting a residual oil of the atmospheric distillation to vacuum distillation, or deep-dewaxed oils obtained by deep-dewaxing the refined oils. In this case, the refining method is not specifically limited and may be carried out in various manners. Generally, one or any suitable combination of (a) hydrogenation treatment, (b) dewaxing treatment (solvent dewaxing or hydrogenation dewaxing), (c) solvent extraction treatment, (d) alkali distillation or sulfuric acid-washing treatment and (e) clay treatment may be adopted and performed in any desired order. It is also effective to repeat the same treatment plural times in multi-stages. For example, there may be adopted (1) a method in which the distillate oil is subjected to a hydrogenation treatment, or after the hydrogenation treatment, the treated oil is further subjected to an alkali distillation or sulfuric acid-washing treatment, (2) a method in which the distillate oil is subjected to a hydrogenation treatment and then to a dewaxing treatment, (3) a method in which the distillate oil is subjected to a solvent extraction treatment and then to a hydrogenation treatment, (4) a method in which the distillate oil is subjected to a two or three-stage hydrogenation treatment, or after the two or three-stage hydrogenation treatment, the treated oil is further subjected to an alkali distillation treatment or sulfuric acid-washing treatment, (5) a method in which after the distillate oil has been subjected to any of the above treatments (1) to (4), the treated oil is again subjected to a dewaxing treatment to obtain a deep dewaxed oil. Irrespective of whichever method is selected, the obtained base oil (gear base oil) is suitably adjusted so that the viscosity, pour point and viscosity index fall within the above ranges. Among the above-described mineral oils, Group II and Group III base oils according to API(American Petroleum Institute) are preferably used for reasons of high viscosity index and excellent oxidation stability.

As the synthetic oil, there may be mentioned, for example, α-olefin oligomers, diesters of dibasic acid, polyol esters, polyglycol esters, alkylbenzenes and alkylnaphthalenes. Among the above-described synthetic oils, Group IV base oils according to API(American Petroleum Institute) are preferably used for reasons of high viscosity index and excellent oxidation stability.

In the present invention, the above-described mineral oils and synthetic oils may be used singly or in combination of two or more thereof.

In the present invention, (A) an ashless dithiocarbamate compound is used. The ashless dithiocarbamate compound is a dithiocarbamate compound which does not contain any metal atom. Preferably used is a compound represented by the following general formula (1):

[Chemical Formula 1]

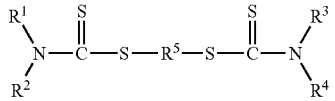

(1)

In the general formula (1), $R^1$ to $R^4$ may be the same or different and each represents a $C_1$ to $C_{30}$ hydrocarbon group and $R^5$ represents a $C_1$ to $C_{10}$ alkylene group. As the $C_1$ to $C_{30}$ hydrocarbon group, there may be mentioned, for example, $C_1$ to $C_{30}$ alkyl groups (such as a methyl group, an ethyl group, an n-propyl group, an isopropyl group, an n-butyl group, an isobutyl group, a sec-butyl group, an n-amyl group, an isoamyl group, an n-hexyl group, a 1-methylpentyl group, a 4-methylpentyl group, a 1,3-dimethylbutyl group, an n-octyl group, a 2-ethylhexyl group, a 2,2,4-trimethylpentyl group, a 2-octyl group, an n-decyl group, an isodecyl group, a lauryl group, a tridecyl group, a myristyl group, a palmityl group, a stearyl group and an isostearyl group), $C_6$ to $C_{30}$ cycloalkyl groups (such as a cyclohexyl group), a phenyl group and $C_7$ to $C_{30}$ alkylaryl groups (such as a p-amylphenyl group, a p-octylphenyl group, a p-nonylphenyl group, a p-dodecylphenyl group and a p-pentadecylphenyl group).

The $R^1$ to $R^4$ groups are each preferably a butyl group and $R^5$ is preferably a methylene group. Methylenebisdibutyl dithiocarbamate is a preferred example of the (A) ashless dithiocarbamate compound.

In the present invention, the (A) ashless dithiocarbamate compounds may be used singly or in combination of two or more thereof. The (A) component is preferably present in an amount of 0.1 to 5.0% by mass, more preferably 0.3 to 4.0% by mass, still more preferably 0.5 to 3.0% by mass, based on the total amount of the composition. When the amount is less than 0.1% by mass, an effect thereof to reduce friction is not obtainable. When the amount is greater than 5.0% by mass, sludge is apt to form at a high temperature.

In the present invention, (B) an ester of pentaerythritol and a $C_{12}$ to $C_{20}$ branched fatty acid is used. The use of a polyhydric alcohol other than pentaerythritol cannot achieve reduction of the coefficient of friction in a satisfactory manner. The use of a straight chain fatty acid tends to cause solidification and precipitation of its ester at a low temperature. When the carbon number of the branched fatty acid is 11 or less, reduction of the coefficient of friction cannot be achieved. When the carbon number of the branched fatty acid is 21 or more, solidification and precipitation of its ester tend to occur at a low temperature.

As the $C_{12}$ to $C_{20}$ branched fatty acid, there may be mentioned isononanoic acid, isotridecanoic acid, isopalmitic acid and isostearic acid. The branched fatty acid moieties in the ester compound may be the same or different. A saturated fatty acid is preferably used. More preferably, a $C_{18}$ branched saturated fatty acid is used. Particularly preferred is isostearic acid.

The (B) component of the present invention has a hydroxyl value of 20 to 100 mg KOH/g, more preferably 30 to 80 mg KOH/g. When the hydroxyl value is less than 20 mg KOH/, an effect thereof to reduce friction is not good so that the transmission efficiency tends to decrease. When the hydroxyl value is greater than 100 mg KOH/g, a sludge is apt to form.

The (B) component may be synthesized by conventionally known esterification of pentaerythritol and the above-described branched fatty acid. By controlling the using amount proportion of the pentaerythritol and branched fatty acid as raw materials, the hydroxyl value of the (B) component may be adjusted to the above-described preferred range.

In the present invention, only one (B) component may be used or two or more (B) components may be used in combination. The (B) component is preferably present in an amount of 0.1 to 10.0% by mass, more preferably 0.3 to 8.0% by mass, still more preferably 0.5 to 5.0% by mass, based on the total amount of the composition. When the amount is less than 0.1% by mass, a satisfactory transmission efficiency is not obtainable. When the amount is greater than 10.0% by mass, sludge is apt to form at a high temperature.

As long as the object of the present invention is not adversely affected, the lubricant oil composition of the present invention may contain, if necessary, other additives such as a viscosity index improver, a pour-point depressant, an ashless dispersant, an antioxidant, an antiwear or extreme pressure agent, a friction reducing agent, a rust preventive agent, a surfactant or a demulsifier, and an antifoaming agent.

As the viscosity index improver, there may be mentioned for example, polymethacrylate, dispersion-type polymethacrylate, olefin-based copolymers (such as ethylene-propylene copolymers), dispersion-type olefin copolymers and styrene-based copolymers (such as styrene-diene copolymers and styrene-isoprene copolymers). The amount of the viscosity index improver is generally 0.1 to 15% by mass, preferably 1 to 10% by mass, based on the total amount of the gear oil composition from the viewpoint of the effect attained by the incorporation thereof.

As the pour point depressant, there may be mentioned for example, polymethacrylate having a weight average molecular weight of 5,000 to 50,000.

Any alkaline earth metal-based detergent used in lubricant oils may be used in the present invention as a metallic detergent. Examples of the metallic detergent include alkaline earth metal sulfonates, alkaline earth metal phenates, alkaline earth metal salicylates and mixtures of two or more thereof. The content of the metallic detergent is generally 1% by mass or less, preferably 0.5% by mass or less, based on the reduced quantity of metallic element.

As the antioxidant, any antioxidant used in lubricant oils may be used. Examples of the antioxidant include phenol-type antioxidants such as 4,4'-methylenebis(2,6-di-t-butylphenol) and amine-type antioxidants such as monooctyldiphenylamine.

As the antiwear agent or extreme pressure agent, there may be mentioned sulfur-containing compounds such as zinc dithiophosphate, zinc dithiocarbamate, organic molybdenum compounds (e.g. molybdenum dithiophosphate), disulfides, sulfurized olefins, sulfurized fats and oils, sulfurized esters, thiocarbonates and thiocarbamates; phosphorus-containing compounds such as phosphorous acid esters, phosphoric acid esters, phosphonic acid esters and amine salts or metal salts thereof; and sulfur- and phosphorus-containing compounds such as thiophosphorous acid esters, thiophosphoric acid esters, thiophosphonic acid esters and amine salts or metal salts thereof.

As the friction reducing agent, any compound commonly used as a friction reducing agent for lubricant oils may be used. Examples of the friction reducing agent include ester compounds other than the (B) component and ashless friction reducing agents such as fatty acids, aliphatic alcohols, aliphatic ethers and aliphatic amines each of which has at least one $C_6$ to $C_{30}$ alkyl or alkenyl group in the molecule.

As the rust preventing agent, there may be mentioned, for example, petroleum sulfonates, alkylbenzenesulfonates, barium sulfonates, dinonylnaphthalenesulfonates, alkenylsuccinic acid esters and polyhydric alcohol esters. The amount of the rust preventing agent is generally 0.01 to 1% by mass, preferably 0.05 to 0.5% by mass, based on the total amount of the gear oil composition from the viewpoint of the effect attained by the incorporation thereof.

As the surfactant or demulsifier, there may be mentioned polyalkylene glycol-type nonionic surfactants such as polyoxyethylene alkyl ethers, polyoxyethylene alkylphenyl ethers and polyoxyethylene alkylnaphthyl ethers.

As the antifoaming agent, there may be mentioned, for example, silicone oils, fluorosilicone oils, fluoroalkyl ethers and polyacrylates. From the standpoint of antifoaming effect and economy, the antifoaming agent is preferably used in an amount of 0.0001 to 0.2% by mass based on the total amount of the gear oil composition.

EXAMPLES

The present invention will be described in further detail by way of examples but is not limited to these examples in any way.

Base Oil:

Base oil 1: mineral oil (ISO viscosity grade: VG 150; API classification: Group II base oil)

Base oil 2: mineral oil (ISO viscosity grade: VG 220; API classification: Group II base oil)

Base oil 3: mineral oil (ISO viscosity grade: VG 320; API classification: Group II base oil)

Ashless Dithiocarbamate Compound:

Methylenebis(dibutyldithiocarbamate) was used.

Ester:

Esters 1 to 6 were synthesized using the polyhydric alcohols and fatty acids shown in Table 1 and were each measured for its hydroxyl value (mg KOH/g) in accordance with JIS K0070.

TABLE 1

| | Polyhydric alcohol | Fatty acid | Hydroxyl value |
|---|---|---|---|
| Ester 1 | pentaerythritol | isostearic acid | 58 |
| Ester 2 | pentaerythritol | isostearic acid | 35 |
| Ester 3 | pentaerythritol | isostearic acid | 126 |
| Ester 4 | pentaerythritol | isostearic acid | 14 |
| Ester 5 | trimethylolpropane | isostearic acid | 43 |
| Ester 6 | pentaerythritol | oleic acid | 60 |

Other Additives:

A sulfur- and phosphorus-based additive X-15179 (manufactured by Afton Chemical) was used.

Using the above base oils and additive, gear oils of Examples 1 to 4 and Comparative Examples 1 to 10 having the compositions and compounding amounts shown in Table 2-1 and Table 2-2 were prepared. The compounding amounts are expressed in terms of parts by mass.

TABLE 2-1

| | | Example | | | | Comparative Example | | |
|---|---|---|---|---|---|---|---|---|
| | | 1 | 2 | 3 | 4 | 1 | 2 | 3 |
| Base oil | Base oil 1 | 96 | 96 | — | — | 98 | 97 | 97 |
| | Base oil 2 | — | — | 96 | — | — | — | — |
| | Base oil 3 | — | — | — | 96 | — | — | — |
| | Methylenebis-(dibutyldithio-carbamate) | 1 | 1 | 1 | 1 | — | 1 | — |
| Ester | Ester 1 | 1 | — | 1 | 1 | — | — | 1 |
| | Ester 2 | — | 1 | — | — | — | — | — |
| | Ester 3 | — | — | — | — | — | — | — |
| | Ester 4 | — | — | — | — | — | — | — |
| | Ester 5 | — | — | — | — | — | — | — |
| | Ester 6 | — | — | — | — | — | — | — |
| | MoDTC | — | — | — | — | — | — | — |

TABLE 2-1-continued

| | | Example | | | | Comparative Example | | |
|---|---|---|---|---|---|---|---|---|
| | | 1 | 2 | 3 | 4 | 1 | 2 | 3 |
| Other additives | | 2 | 2 | 2 | 2 | 2 | 2 | 2 |
| Coefficient of Friction | 30 lbs | 0.058 | 0.055 | — | — | 0.065 | 0.062 | 0.066 |
| | 40 lbs | 0.060 | 0.063 | — | — | 0.084 | 0.072 | 0.088 |
| | 50 lbs | 0.070 | 0.080 | — | — | 0.122 | 0.116 | 0.116 |
| IOT | | 4.2 | 5.1 | — | — | 8.6 | 9.5 | 3.0 |
| Measurement of efficiency in actual use | | 96.60 | — | 95.72 | 95.32 | 95.40 | 95.86 | 95.51 |

TABLE 2-2

| | | Comparative Example | | | | | | |
|---|---|---|---|---|---|---|---|---|
| | | 4 | 5 | 6 | 7 | 8 | 9 | 10 |
| Base oil | Base oil 1 | 96 | 96 | 96 | 96 | 97 | — | — |
| | Base oil 2 | — | — | — | — | — | 97 | — |
| | Base oil 3 | — | — | — | — | — | — | 97 |
| Methylenebis-(dibutyldithio-carbamate) | | 1 | 1 | 1 | 1 | — | 1 | 1 |
| Ester | Ester 1 | — | — | — | — | — | — | — |
| | Ester 2 | — | — | — | — | — | — | — |
| | Ester 3 | 1 | — | — | — | — | — | — |
| | Ester 4 | — | 1 | — | — | — | — | |
| | Ester 5 | — | — | 1 | — | — | — | — |
| | Ester 6 | — | — | — | 1 | — | — | — |
| MoDTC | | — | — | — | — | 1 | — | — |
| Other additives | | 2 | 2 | 2 | 2 | 2 | 2 | 2 |
| Coefficient of Friction | 30 lbs | 0.058 | 0.062 | 0.070 | 0.058 | 0.059 | — | — |
| | 40 lbs | 0.072 | 0.082 | 0.100 | 0.082 | 0.063 | — | — |
| | 50 lbs | 0.078 | 0.112 | 0.102 | 0.102 | 0.082 | — | — |
| IOT | | 22.6 | 7.8 | 4.6 | 42.5 | 38.8 | — | — |
| Measurement of efficiency in actual use | | — | — | — | — | 96.13 | 95.10 | 94.57 |

Each of the above-obtained lubricant oil compositions was tested and measured as shown below. The results are shown in Table 2-1 and Table 2-2.

LFW-1 Test:

Using a block-ring shown below, the test was carried out with a load of 30 to 50 lbs, at a revolution speed of 1,000 rpm and at an oil temperature of 40° C. to determine a coefficient of friction.

Material of the block: S-10

Material of the ring: H-60

Indiana Oxidation Test: IOT

The IOT test was carried out under conditions including a temperature of 121° C., a test time of 312 hours and an air feed rate of 10 L/hr. Tested oil (100 mL) was filtered to measure the amount of sludge.

Measurement Method of Transmission Efficiency in Actual Use:

A transmission efficiency in actual use was measured using the measurement device, measurement conditions and calculation formula shown below.

Measurement Device:

A device having the following instruments (1) to (6) connected in line in the order of increasing numbers was used.

(1) Motor: Motor SF-JR manufactured by Mitsubishi Electric Corporation (2) Torque meter for measuring input torque: Torque meter TOR-5 manufactured by Nikkei Densoku Co., Ltd.

(3) Gear unit: Gear unit GL6-30 manufactured by Aoki Seimitsu Kogyo Co., Ltd. (reduction gear ratio: 30:1)

(4) Torque meter for measuring output torque: Torque meter TOR-100 manufactured by Nikkei Densoku Co., Ltd.

(5) Speed increasing gear: Speed increasing gear ER-170 manufactured by Shinpo Kogyo Kabushiki Kaisha (6) Hydraulic pump: Hydraulic pump V-104C manufactured by Tokimec Inc.

A coupling CF-A-012-S12-1360 manufactured by Miki Pulley Co., Ltd. was used for the connection between (1) and (2) and between (2) and (3). A coupling CF-A-050-S12-1360 manufactured by Miki Pulley Co., Ltd. was used for the connection between (3) and (4). A blower was disposed at a position about 1 m away from the gear unit for cooling the gear unit.

Measurement Conditions:

The motor was rotated at 1,800 rpm to drive the gear unit (reduction gear ratio: 30:1) and to drive the hydraulic pump through the speed increasing gear. When the oil temperature of 39±0.5° C. was reached, the input torque (Ti) and output torque (To) were measured with the torque meters, from which the energy transmission efficiency was calculated according to the formula shown below.

Prior to the measurement of the gear oils of Examples and Comparative Examples, running-in was carried out at a motor revolution speed of 1,800 rpm using NONBOC M460 manufactured by Nippon Oil Corporation.

Calculation of Transmission Efficiency:

The energy transmission efficiency was calculated according to the following formula:

Energy transmission efficiency (%)=100×To/Ti/30=3.3333To/Ti

The gear oil compositions of Examples 1 and 2 have a coefficient of friction which is comparable to or superior to that of Comparative Example 8 containing MoDTC and can reduce the amount of sludge formation to about 10% of that of Comparative Example 8. Further, as will be appreciated from the results of the transmission efficiency measurement using the gear efficiency measurement device, the present invention can achieve about 0.5 to 1.0% improvement of the transmission efficiency. On the other hand, in Comparative Examples 2 and 3 in which the (A) component and (B) component are used separately, no significant effect of reducing the coefficient of friction is obtained. Further, in Comparative Examples 4 to in which an ester compound whose hydroxyl value does not fall within the range of 20 to 100 mg KOH/g is used, an ester compound whose polyhydric alcohol is not pentaerythritol is used, and an ester compound whose fatty acid is straight chained is used, respectively, it is not possible to achieve both of reduction of coefficient of friction and reduction of sludge formation at the same time.

INDUSTRIAL APPLICABILITY

The gear oil composition of the present invention has a high transmission efficiency and can show both of resistance to sludge formation and extreme pressure property and, therefore, can achieve energy saving.

The invention claimed is:

1. A gear oil composition comprising a mineral base oil, (A) an ashless dithiocarbamate compound, and (B) an ester of pentaerythritol and isostearic acid, wherein said ashless dithiocarbamate compound is present in the gear oil composition in an amount of from 1 to 5.0% by mass based on the total amount of the gear oil composition, said ester having a hydroxyl value of 20 to 100 mg KOH/g and present in an amount of from 0.1 to 8.0% by mass based on the total amount of the gear oil composition, and said ashless dithiocarbamate compound comprises at least one compound represented by formula (1)

[Chemical Formula 1]

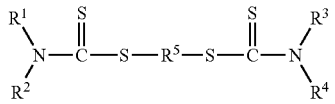

(1)

where $R^1$ to $R^4$ may be the same or different and each represents a $C_1$ to $C_{30}$ hydrocarbon group and $R^5$ represents a $C_1$ to $C_{10}$ alkylene group.

2. The gear oil composition as recited in claim 1, wherein the mineral base oil comprises at least one mineral oil having a kinematic viscosity of from 10 to 4,600 $mm^2/s$ at 40° C.

3. The gear oil composition as recited in claim 1, wherein the mineral base oil comprises at least one mineral oil having a kinematic viscosity of from 20 to 1,000 $mm^2/s$ at 40° C.

4. The gear oil composition as recited in claim 1, wherein the mineral base oil comprises at least one mineral oil having a kinematic viscosity of from 32 to 500 $mm^2/s$ at 40° C.

5. The gear oil composition as recited in claim 1, wherein the mineral base oil has a pour point of −5° C. or lower.

6. The gear oil composition as recited in claim 1, wherein the mineral base oil has a pour point of −15° C. or lower.

7. The gear oil composition as recited in claim 1, wherein the mineral base oil has a pour point of −25° C. or lower.

8. The gear oil composition as recited in claim 1, wherein the mineral base oil has a viscosity index of 80 or more.

9. The gear oil composition as recited in claim 1, wherein the mineral base oil has a viscosity index of 95 or more.

10. The gear oil composition as recited in claim 1, wherein the mineral base oil is present in the gear oil composition in an amount of at least 96 parts by mass, relative to 100 parts by mass of the gear oil composition.

11. The gear oil composition as recited in claim 1, wherein each of $R^1$ to $R^4$ is a butyl group and $R^5$ is a methylene group.

12. The gear oil composition as recited in claim 2, wherein said ashless dithiocarbamate compound comprises methylenebisdibutyl dithiocarbamate.

13. The gear oil composition as recited in claim 1, wherein said ester has a hydroxyl value of 30 to 80 mg KOH/g.

14. The gear oil composition as recited in claim 1, wherein said ester has a hydroxyl value of 35 to 58 mg KOH/g.

15. The gear oil composition as recited in claim 1, further comprising 0.01 to 1% by mass, relative to the total mass of the gear oil composition, of an antirust agent selected from the group consisting of a petroleum sulfonate, an alkylbenzenesulfonate, a barium sulfonate, a dinonylnaphthalenesulfonate, an alkenylsuccinic acid ester and a polyhydric alcohol ester.

16. The gear oil composition as recited in claim 1, which does not contain an ester of pentaerythritol and oleic acid.

* * * * *